US007748798B2

(12) United States Patent
LeTourneau et al.

(10) Patent No.: US 7,748,798 B2
(45) Date of Patent: Jul. 6, 2010

(54) COLLAPSIBLE FURNITURE AND BRACES USEFUL THEREWITH

(75) Inventors: Alex V. LeTourneau, Sheboygan, WI (US); Michael S. Kohlman, Sheboygan, WI (US); Michael Terrill, Cedarburg, WI (US); Scott R. Krebs, Sheboygan Falls, WI (US); John C. Campbell, Bettendorf, IA (US); David J. Kroening, Moline, IL (US); Jeffrey Laundre, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 497 days.

(21) Appl. No.: 11/586,356

(22) Filed: Oct. 25, 2006

(65) Prior Publication Data

US 2008/0100188 A1 May 1, 2008

(51) Int. Cl.
*A47B 43/00* (2006.01)

(52) U.S. Cl. ..... 312/258; 312/228; 4/630

(58) Field of Classification Search ..... 312/258, 312/322, 257.1, 259, 326, 329, 265, 5, 6, 312/262, 228, 240; 206/600; 220/6, 7, 8; 248/436, 166; 108/115; 4/630
See application file for complete search history.

(56) References Cited

U.S. PATENT DOCUMENTS

| | | | | | |
|---|---|---|---|---|---|
| 168,879 | A | * | 10/1875 | Colbert | 312/240 |
| 175,308 | A | * | 3/1876 | Van Wie | 312/238 |
| 582,229 | A | * | 5/1897 | Reynolds | 224/432 |
| 1,281,731 | A | | 10/1918 | Widlak | |
| 1,342,269 | A | * | 6/1920 | Stewart | 312/258 |
| 2,132,988 | A | * | 10/1938 | Leibo | 403/95 |
| 2,442,154 | A | * | 5/1948 | Vunovich | 312/262 |
| 2,539,951 | A | * | 1/1951 | Hall | 296/102 |
| 2,558,209 | A | * | 6/1951 | Derman | 312/195 |
| 2,639,114 | A | * | 5/1953 | Allen | 248/167 |
| 2,925,979 | A | * | 2/1960 | Walker | 248/146 |
| 2,960,993 | A | * | 11/1960 | Holmstrom | 135/130 |
| 3,061,396 | A | * | 10/1962 | Hock | 312/258 |
| 3,096,923 | A | * | 7/1963 | Piller | 229/199 |
| 3,140,133 | A | * | 7/1964 | Kraft | 312/140.2 |
| 3,294,464 | A | * | 12/1966 | Lew | 312/258 |
| 3,376,994 | A | * | 4/1968 | Flinn, Jr. | 220/6 |
| 3,458,242 | A | * | 7/1969 | Williams | 312/258 |
| 3,527,339 | A | * | 9/1970 | Cipolla | 206/290 |
| 3,527,340 | A | * | 9/1970 | Cipolla | 206/278 |
| 3,602,388 | A | * | 8/1971 | Hurkamp | 220/1.5 |

(Continued)

FOREIGN PATENT DOCUMENTS

| | | |
|---|---|---|
| FR | 2817454 | 6/2002 |

(Continued)

OTHER PUBLICATIONS

PCT International Search Report, Form PCT/US2007/021691.

*Primary Examiner*—James O Hansen
(74) *Attorney, Agent, or Firm*—Quarles & Brady LLP

(57) ABSTRACT

Furniture such as bathroom vanities are suitable to be shipped in collapsed form and then readily assembled/erected at the installation site. A back wall folds forwardly as bracing along the front folds vertically in one form. There can be a multi-piece collapsible brace between opposed side walls with four pivot points.

4 Claims, 6 Drawing Sheets

U.S. PATENT DOCUMENTS 3,801,208 A 4/1974 Bourgraf et al.
3,865,269 A * 2/1975 Coleman ..... 220/6
3,950,758 A 4/1976 Mirrione et al.
3,955,864 A * 5/1976 MacDonald et al. ..... 312/258
3,975,069 A * 8/1976 DeLucia ..... 312/262
3,989,156 A * 11/1976 Lowry ..... 220/4.31
3,998,509 A 12/1976 Hauser
4,003,170 A * 1/1977 Mellyn ..... 52/173.2
4,065,195 A 12/1977 Fahmie
4,128,284 A 12/1978 King
4,191,439 A 3/1980 Cohen
4,243,263 A * 1/1981 Thiboutot ..... 297/42
4,279,455 A 7/1981 Santo
4,579,401 A * 4/1986 Mears ..... 312/258
4,684,034 A * 8/1987 Ono et al. ..... 220/6
4,703,981 A * 11/1987 Stewart ..... 312/258
4,867,513 A * 9/1989 Choi ..... 312/258
4,934,025 A * 6/1990 Mariol ..... 16/347
5,279,006 A * 1/1994 Teng ..... 5/99.1
5,308,157 A 5/1994 Dyer
5,323,921 A * 6/1994 Olsson ..... 217/12 R
5,511,758 A * 4/1996 Hsu ..... 248/461
5,539,957 A * 7/1996 Schmidt ..... 16/331
5,593,046 A * 1/1997 Katsuura et al. ..... 211/41.15
5,647,181 A 7/1997 Hunts
5,664,854 A * 9/1997 Letch ..... 312/262
5,943,968 A 8/1999 Dobson et al.
6,073,943 A * 6/2000 Serrault ..... 280/47.26
6,125,483 A * 10/2000 Stroud et al. ..... 5/99.1
6,173,726 B1 * 1/2001 Talmadge ..... 135/144
6,182,935 B1 * 2/2001 Talesky ..... 248/436
6,250,837 B1 * 6/2001 Mariol et al. ..... 403/102
6,276,548 B1 * 8/2001 Mitchell ..... 220/9.4
6,364,440 B2 * 4/2002 Donahue ..... 312/228
6,578,500 B2 6/2003 Malizia
6,588,033 B1 * 7/2003 Welsh et al. ..... 5/99.1
6,606,809 B2 * 8/2003 Hillstrom et al. ..... 40/610
6,722,293 B2 * 4/2004 Lee ..... 108/118
6,722,750 B2 * 4/2004 Chan ..... 312/258
6,752,364 B1 6/2004 Lim
6,766,623 B1 7/2004 Kalnay
6,779,466 B2 8/2004 Shabram, Jr.
6,848,758 B1 * 2/2005 Yeh et al. ..... 312/258
6,851,564 B2 2/2005 Ng
6,948,787 B2 * 9/2005 McBrayer et al. ..... 312/258
2004/0050008 A1 * 3/2004 Mintie et al. ..... 52/646
2005/0060802 A1 * 3/2005 Zhong ..... 5/120
2005/0072340 A1 4/2005 Shabram et al.
2006/0021136 A1 * 2/2006 Cheng ..... 5/99.1
2006/0076045 A1 * 4/2006 Lee ..... 135/144
2007/0164023 A1 * 7/2007 Lapoint, III ..... 220/6
2007/0242422 A1 * 10/2007 Cheng et al. ..... 361/683

FOREIGN PATENT DOCUMENTS

GB 1576479 10/1980

* cited by examiner

COLLAPSIBLE FURNITURE AND BRACES USEFUL THEREWITH

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to furniture such as bathroom vanities. More particularly it relates to bracket structures, collapsible walls and foldable bracing structures that facilitate assembly of such furniture.

Bathroom vanities typically have four main walls (front door frame, left side, right side and rear frame), with an open top. There may also be a bottom wall forming a storage shelf. A separate countertop with lavatory basin is supported by the vanity so that a basin drain extends into the vanity and out the vanity's rear frame. Water is typically fed to a faucet mounted through the countertop via the vanity's rear frame.

Such vanities are sometimes purchased in an already assembled form. However, even a relatively small vanity may be difficult to ship from the store or warehouse to the installation site unless the shipper has a pick-up truck or other large capacity vehicle. This may make it difficult for some consumers to transport the vanities themselves.

Moreover, if the vanity is already assembled during shipment it may be difficult to transport through some doorways at the installation site. Further, an already assembled vanity may take up undesirable amounts of display space at retailers. These problems can be exacerbated as the size of the vanity or other furniture item grows (e.g. a vanity suitable for a double basin sink).

Hence, it is desirable to be able to store a vanity and ship it to the installation site in a collapsed/unassembled form. Thereafter, the vanity can be constructed on-site.

However, there are a number of problems with this strategy. For example, if the assembly requires skilled labor, that can limit who can install the vanity, and further can unduly increase the cost of installation. Even where the assembly does not require skilled labor, if it is time consuming or requires following complex instructions, consumers may be dissatisfied with the process.

Also, if assembly requires special tools, that may cause further delays and problems. Moreover, some assembly techniques are prone to causing breakage or insecure connections.

U.S. Pat. Nos. 3,458,242 and 3,975,069 disclose collapsible vanities that can be constructed at the point of use in expedited fashion. As particularly shown in the U.S. Pat. No. 3,975,069 the collapsed form presents an almost suitcase-like appearance. However, the structure that permits collapsing and expanding requires complex bracing structures and has sturdiness concerns.

U.S. Pat. No. 6,779,466 disclosed a collapsible folding table. Again, there are some concerns regarding stability and complexity.

Other examples of collapsible apparatus are disclosed in U.S. Pat. Nos. 1,281,731, 3,801,208, 3,950,758, 4,065,195, 4,934,025, 5,308,157, 5,593,046, 5,664,854, 5,943,968, 6,578,500, 6,752,364, 6,766,623, 6,848,758, 6,851,564 and U.S. patent application publication 2005/0072340. Each of these assemblies has their limitations.

U.S. Pat. No. 3,998,509 disclosed a fastener for interlocking the corner portions of mutually orthogonal rectangular sheets, which could be used with a rectangular case. A disadvantage of this type of system was that it relied on a weak frictional connection. Further, the system did not adapt well to different thicknesses of walls.

U.S. Pat. No. 4,191,439 disclosed a drawer construction in which brackets took the place of conventional dovetail joints. However, this type of assembly either left the brackets visible, or required a front wall to significantly overhang the side walls to avoid the bracket visibility.

Other examples of apparatus for connecting perpendicular side panels are disclosed in U.S. Pat. Nos. 4,128,284, 4,279,455 and 5,647,181. Each of these techniques had their limitations.

Thus, a need still exists for improved collapsible furniture items which can be readily assembled at installation sites.

SUMMARY OF THE INVENTION

In one aspect the present invention provides an item of furniture having a first side panel, a second side panel opposed to the first side panel so as to partially define an internal space there between, a wall extending between the first and second side panels so as to further define the internal space, and a brace also extending between the first and the second side panels at a position relative to the internal space opposite the wall. The wall can be folded inwardly between the first and second side panels (preferably into the internal space forwardly) in a first direction, and the brace can be folded in a second direction transverse to the first direction (preferably downwardly). Thus, the furniture item (e.g. a bathroom vanity) is suitable to be collapsed from an erected configuration to a more compact configuration.

In a preferred form there is a brace which includes a first corner bracket mounted on the first side panel, a second corner bracket mounted on the second side panel, a first connector pivotably linked to the first corner bracket, a second connector pivotably linked to the second corner bracket, a central hinge plate, a third connector linked at one side of the central hinge plate so as to be releasably pivotable relative thereto, a fourth connector linked at a second side of the central hinge plate so as to be releasably pivotable relative thereto, a first arm extending between the first and third connectors, a second arm extending between the second and fourth connectors, and biased restraints for releasably restricting pivotal motion of the third and fourth connectors relative to the central hinge plate.

The first connector may have a dovetail connection with the first side panel and the second connector may have a dovetail connection with the second side panel. There may also be a spring that restricts movement of the third connector along its axis of pivoting relative to the central hinge plate, with the central hinge plate including a stop surface to restrict pivoting of the third connector relative to the central hinge panel except when the third connector has been moved sufficiently along said axis.

The panels of the furniture item/vanity can be stacked on top of each other and inserted into a compact carton for shipment and storage. When the panels are removed from the carton at a construction site, one can simply expand the panels to assemble.

While the preferred furniture item is a vanity which has a sink mounted thereon, other furniture items such as, but not limited to, cabinets (stand alone or wall mounted), shelves, bed frames, credenzas, desks, tables, islands, and other furniture pieces could have the principles of the present invention applied to them.

It should be appreciated that the furniture items of the present invention can be shipped in compact or disassembled form. Erecting or assembling these structures is straightforward and quick.

The present invention permits the furniture to be shipped and stored prior to installation in a disassembled or collapsed state, which allows for smaller packaging, less display space requirements at retail, and easier transport to the worksite. Further, the assembly method can be achieved with a minimum of tools by largely unskilled persons.

These and still other advantages of the present invention will be apparent from the detailed description which follows and the accompanying drawings. Hence, the following claims should be looked to in judging the full scope of the invention.

DETAILED DESCRIPTION OF THE PREFERRED EMBODIMENT

Figure 1:
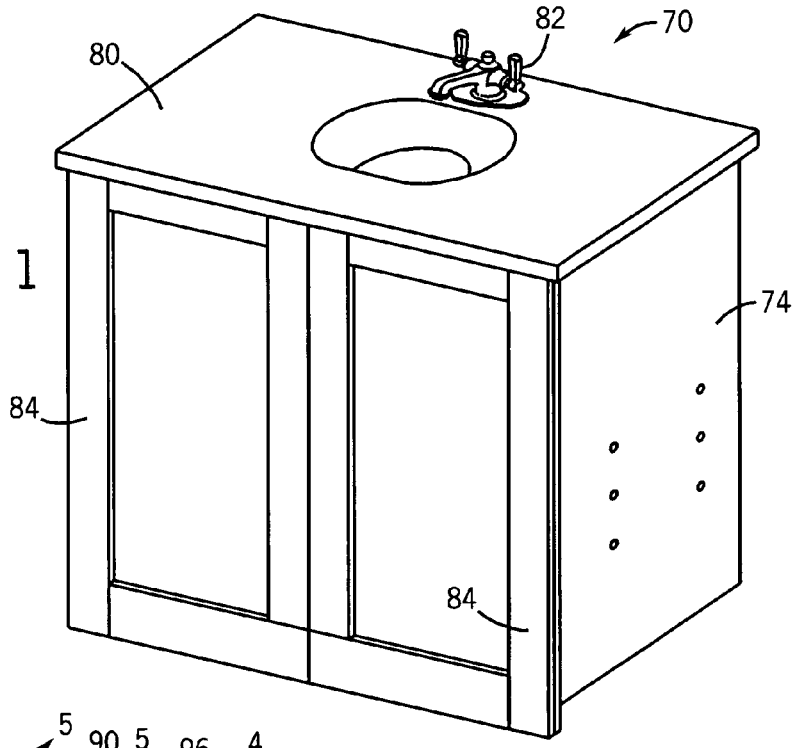
FIG. 1 is a perspective front view of an embodiment of a vanity incorporating foldable rear wall and foldable brace attributes of the present invention.
Figure 3A:
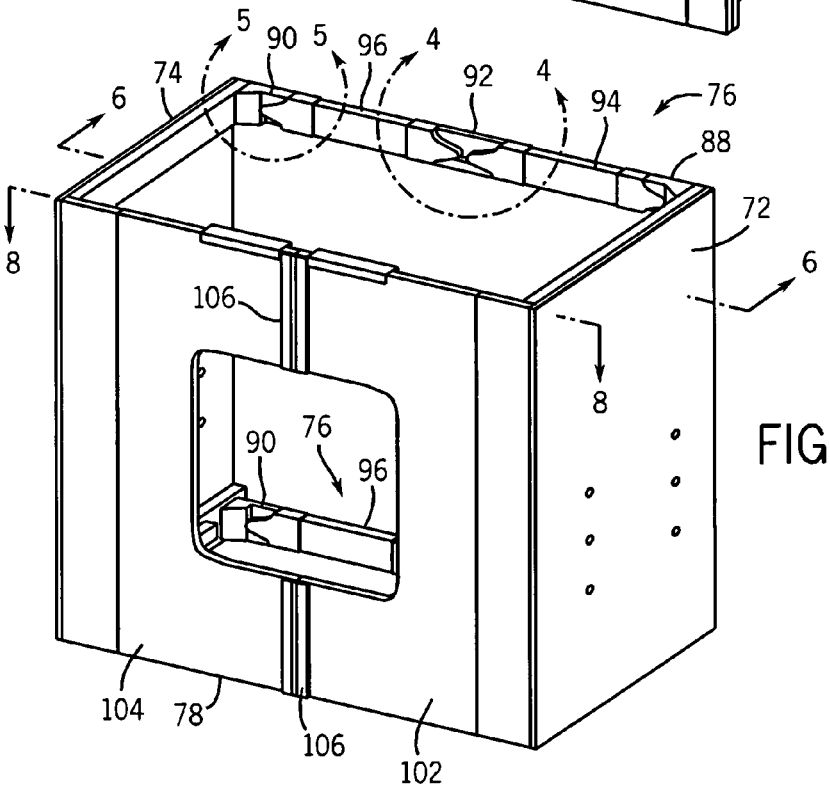
FIG. 3A is a rear perspective view of the vanity of FIG. 1, with the sink and front doors removed.
Figure 2:
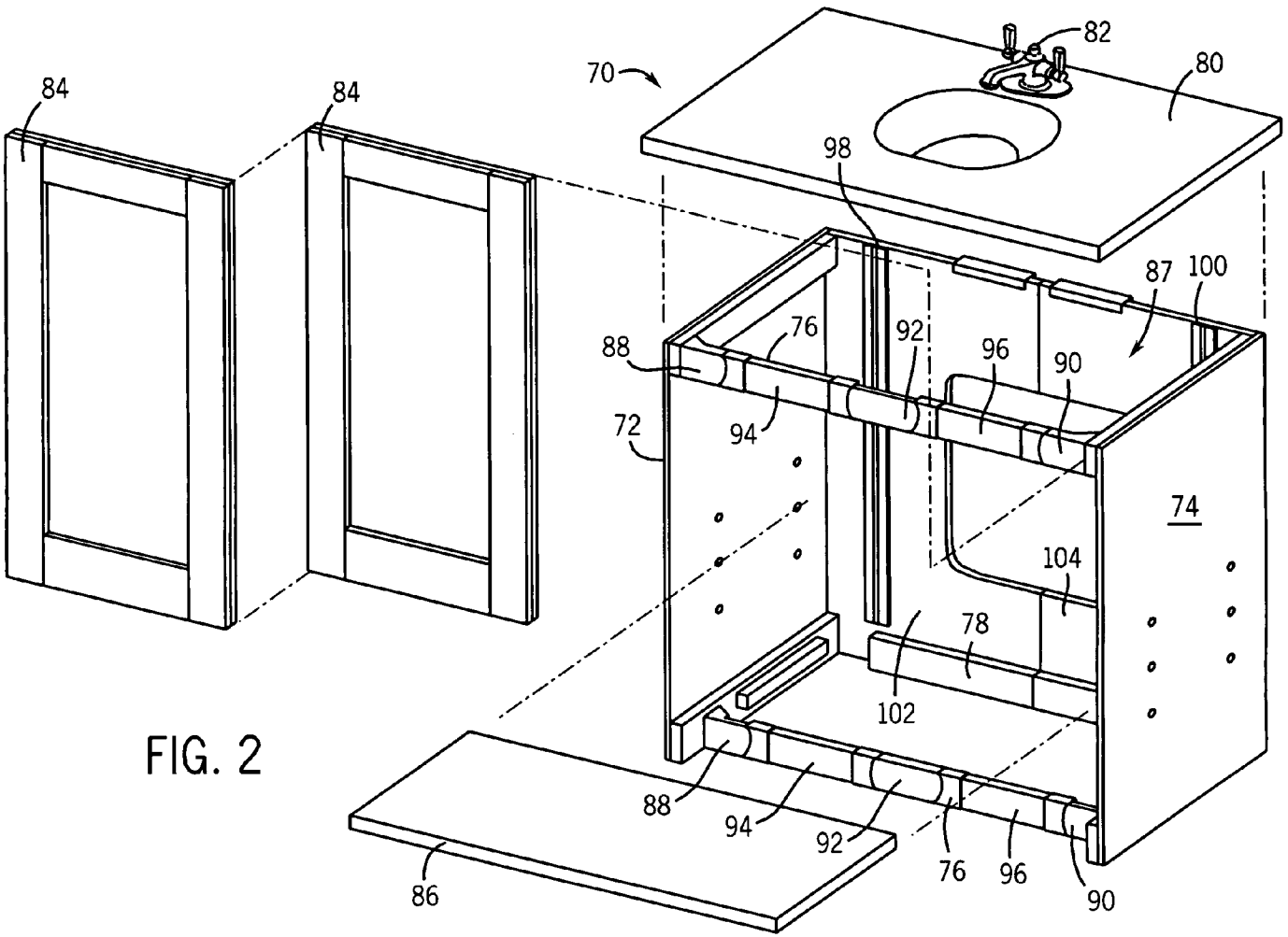
FIG. 2 is an exploded, perspective front view of the vanity of FIG. 1.
Figure 3B:
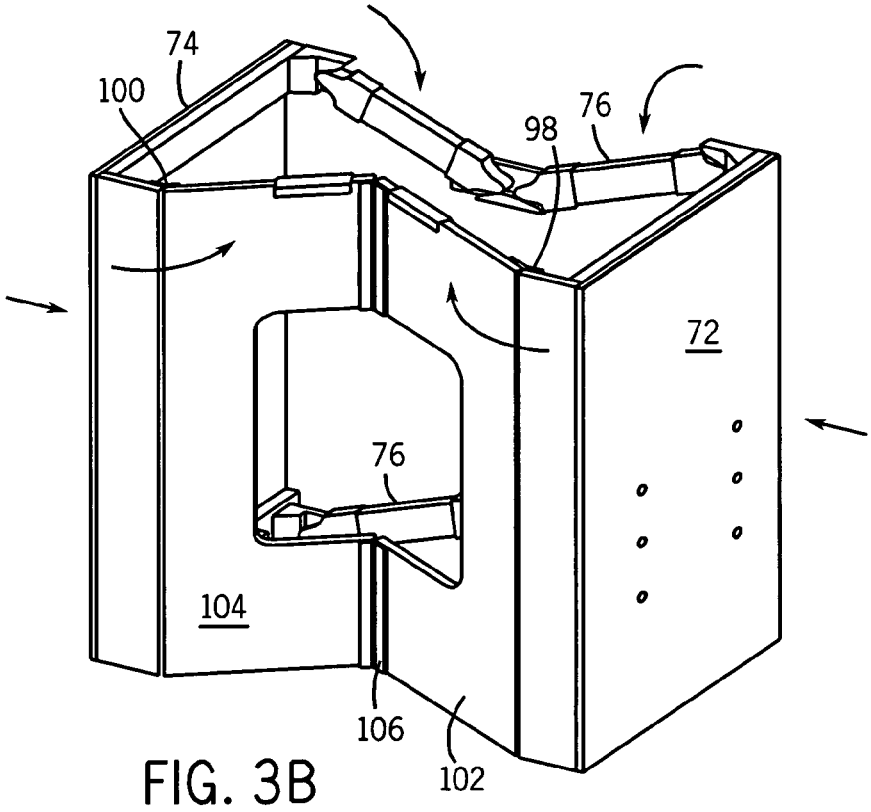
FIG. 3B is a view similar to FIG. 3A, but with the rear wall and bracing beginning to fold.
Figure 3C:
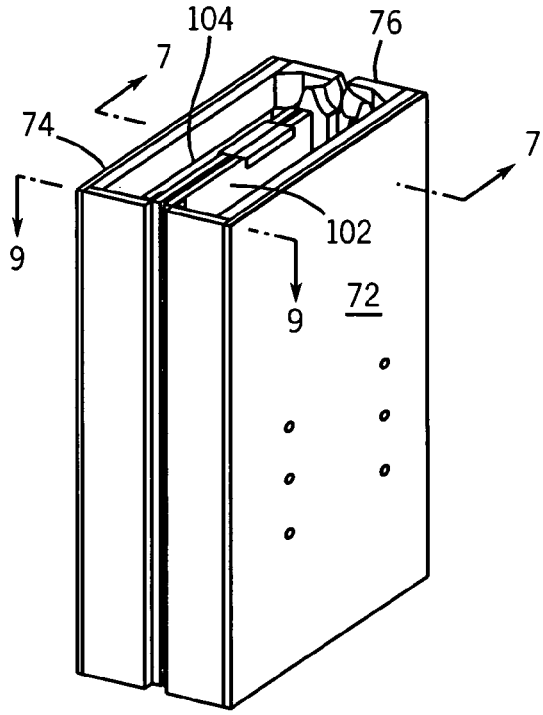
FIG. 3C is a view similar to FIG. 3B, but showing the vanity completely collapsed.

FIGS. 1-9 disclose a furniture item 70 which has a first side panel 72, a second side panel 74, at least one brace 76 connected between first side panel 72 and the second side panel 74, and a rear wall 78 connected between the first and second side panels opposite braces 76. There is a counter top 80 with the usual sink basin, a faucet 82, doors 84 hinged to the vanity in a conventional manner, and a shelf 86 further defining an internal storage area 87.

Each brace 76 includes a first corner bracket 88, a second corner bracket 90, connectors 110 and 112 linked to a center hinge plate 92, and arm members 94 and 96 connecting the connectors 110 and 112 to the brackets.

There is also a first hinge 98 that connects first panel 72 and rear wall 78, and a second hinge 100 that connects second panel 74 and rear wall 78. Further, rear wall 78 includes a first part 102 connected to first hinge 98, a second part 104 connected to second hinge 100, and a third hinge 106 connecting first part 102 and second part 104. Hinges 98, 100 and 106 are preferably piano hinges, for example.

When furniture item 70 is in an erected position, braces 76 can pivot vertically (preferably towards each other), and first part 102 and second part 104, of rear wall 78, can pivot inwardly. This two-directional folding is depicted best in FIG. 3B, and if continued can result in the compact structure of FIG. 3C.

Figure 4:
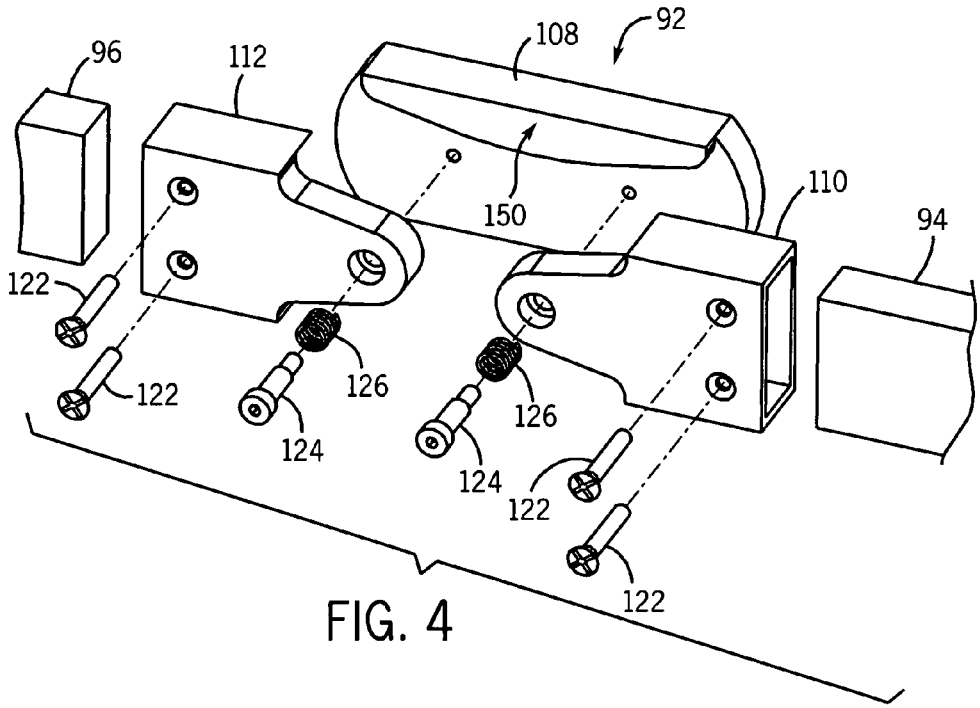
FIG. 4 is an exploded enlarged perspective view of portion 4-4 of FIG. 3A.

Referring now to FIG. 4, each center hinge plate 92 includes a center base 108, with connector 110 pivotably connected to one side of center base 108, and connector 112 pivotably connected to another side of center base 108. Connector 110 is fixedly connected at another end thereof to first arm 94, and connector 112 is fixedly connected at another end thereof to arm 96. This may be achieved with conventional screws 122 or via other means.

Figure 5:
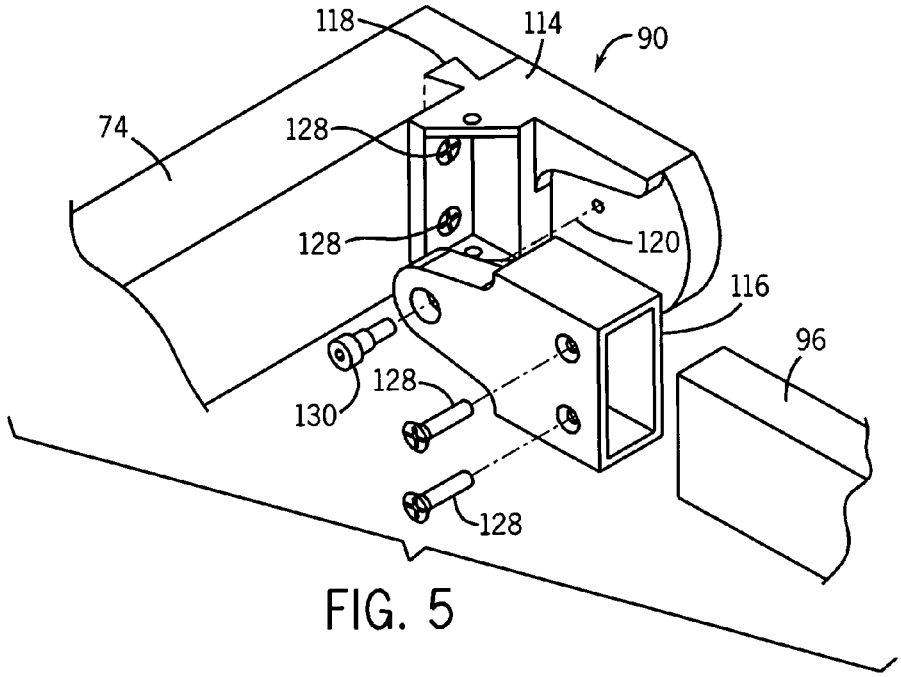
FIG. 5 is an exploded enlarged perspective view of portion 5-5 of FIG. 3A.
Figure 7:
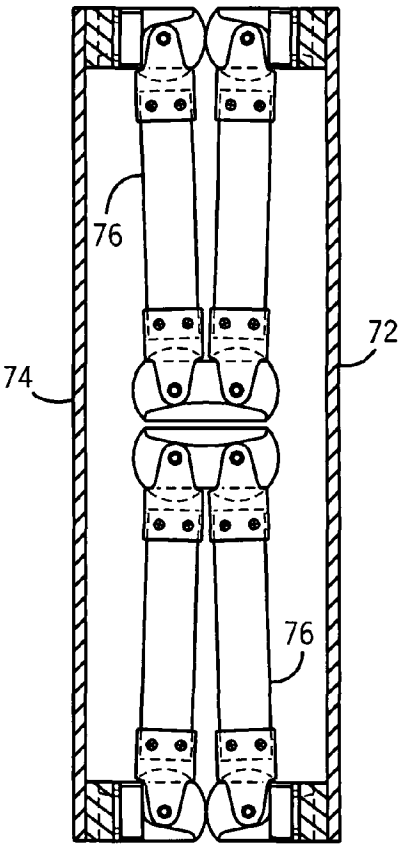
FIG. 7 is a cross-sectional view taken along section line 7-7 in FIG. 3C.
Figure 6:
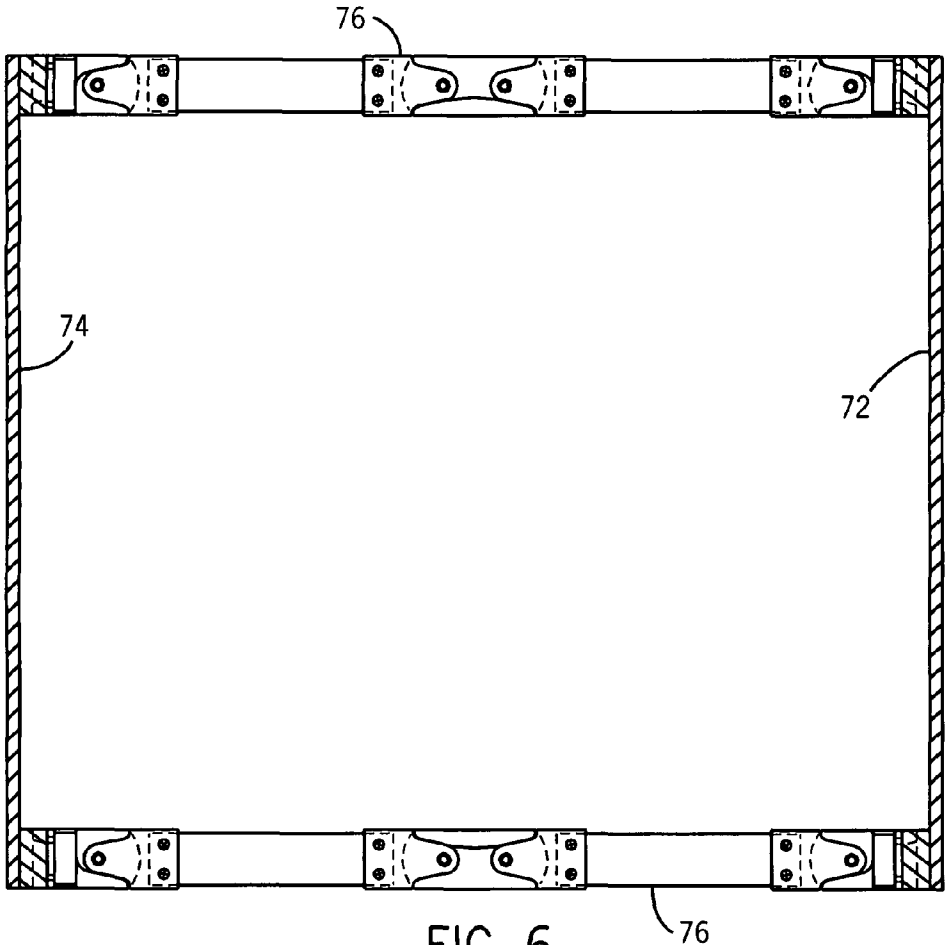
FIG. 6 is a cross-sectional view taken along line 6-6 in FIG. 3A.
Figure 9:
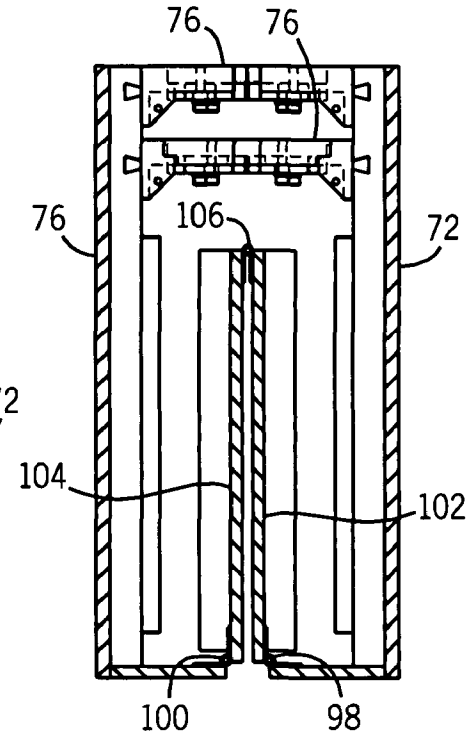
FIG. 9 is a cross-sectional view taken along section line 9-9 in FIG. 3C.
Figure 8:
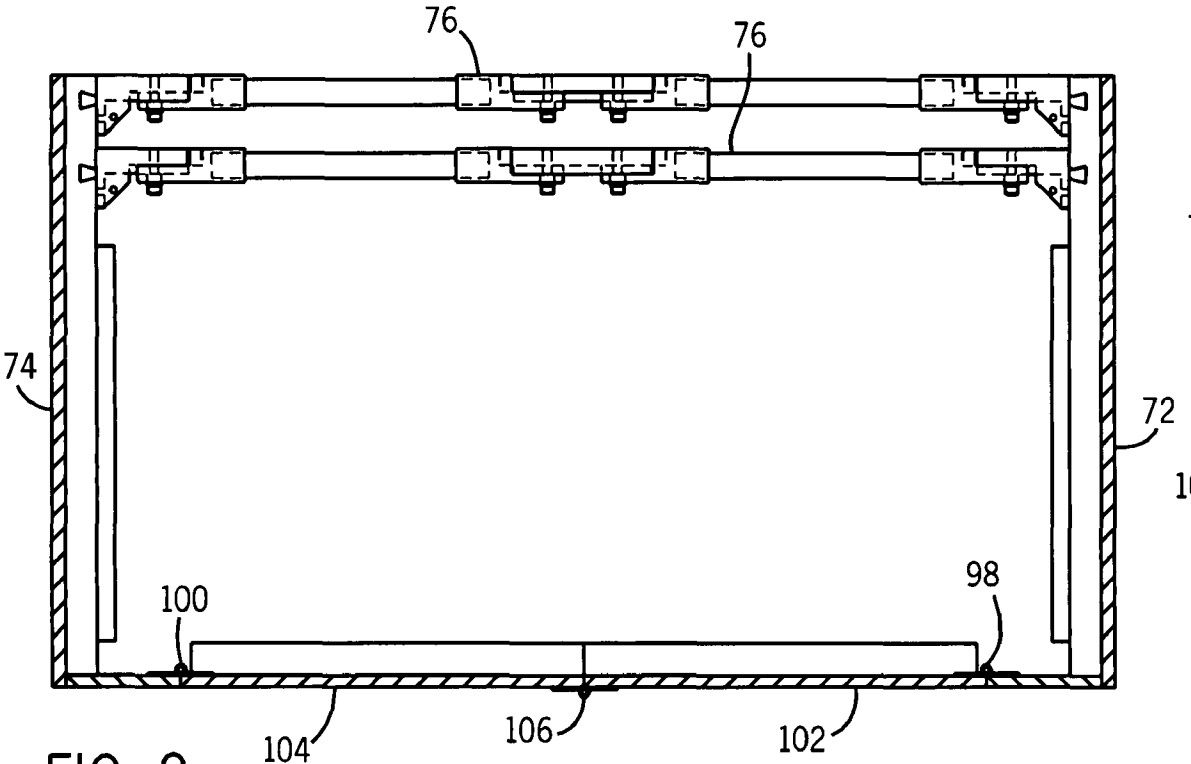
FIG. 8 is a cross-sectional view taken along section line 8-8 in FIG. 3A.

Referring now to FIG. 5, each the corner bracket 88, 90 includes a base 114 fixedly connected to a respective panel 72, 74, and a connector 116 pivotably connected to base 114 and fixedly connected to a respective arm 94, 96. However, to accommodate the right handedness of corner bracket 88, and the left handedness of corner bracket 90, respective bases and arms of brackets 88, 90 are preferably mirror images of one another. Each base 114 can include a dovetail extension 118 and a pivot axis 120 transverse to dovetail extension 118.

Center hinge plate 92 is connected to connectors 110, 112 via "shoulder" screws 124 and biasing elements such as springs 126. Similarly, connectors 116 are connected to arms 94, 96 using screws 128, and connected to bases 114 with shoulder screws 130.

When the connectors 110 and 112 are freed to pivot relative to the base 108, the connectors 116 will follow the pivoting relative to bases 114. However, the connectors 110 and 112 may normally be prevented from an undesired direction of pivoting by a stop like stop 150. When they are pulled against the spring pressure towards the heads of the shoulder screws 124 they can be made to clear the stop 150, and thus rotate.

Hence, this configuration normally resists collapsing of the brace. However, this will permit the brace to be collapsed when it is desired to make the configuration compact for storage or shipment.

Hence, the embodiment of FIGS. 1-9 can be collapsed for shipment and storage, and then erected and finalized on-site with minimal tools and time.

The above features are relatively low cost to produce. Further, they provide a secure construction for the most typical applications.

While an embodiment has been described above, it should be appreciated that this is merely the preferred embodiment. Therefore, the present invention is not to be limited to just the described preferred embodiment. To ascertain the full scope of the invention, the claims which follow should be referenced.

INDUSTRIAL APPLICABILITY

The present invention provides vanities and other furniture items which are capable of being shipped in collapsed fashion and quickly assembled.

We claim:

1. An item of furniture, comprising:

a first side panel;

a second side panel opposed to the first side panel so as to partially define an internal storage space there between;

a wall extending between the first and second side panels so as to further define said internal storage space; and a brace also extending between the first and the second side panels at a position relative to the internal storage space opposite the wall;

wherein the wall can be folded inwardly between the first and second side panels in a first direction, and the brace can be folded in a second, vertical direction transverse to the first direction; and whereby the item of furniture is suitable to be collapsed from an erected configuration to a more compact configuration;

wherein the brace comprises:

a first corner bracket mounted on the first side panel;

a second corner bracket mounted on the second side panel;

a first connector pivotably linked to the first corner bracket;

a second connector pivotably linked to the second corner bracket;

a central hinge plate;

a third connector linked at one side of the central hinge plate so as to be releasably pivotable relative to the central hinge plate;

a fourth connector linked at a second side of the central hinge plate so as to be releasably pivotable relative to the central hinge plate;

a first arm extending between the first and third connectors;

a second arm extending between the second and fourth connectors; and springs restricting pivotal motion of the third and fourth connectors relative to the central hinge plate.

2. The item of furniture of claim 1, wherein the first corner bracket has a dovetail connection with the first side panel and the second corner bracket has a dovetail connection with the second side panel.

3. The item of furniture of claim 1, wherein the springs restrict movement of the third connector along its axis of pivoting relative to the central hinge plate, and the central hinge plate includes a stop surface to restrict pivoting of the third connector relative to the central hinge panel except when the third connector has been moved sufficiently along said axis.

4. The item of furniture of claim 1, wherein said item of furniture is a bathroom vanity.

* * * * *